US011821228B2

(12) United States Patent
Sun et al.

(10) Patent No.: US 11,821,228 B2
(45) Date of Patent: Nov. 21, 2023

(54) FOLDABLE TENT CENTER LOCK DEVICE WITH ROTARY UNLOCKING STRUCTURE

(71) Applicant: ZHEJIANG JIANSHENG LEISURE PRODUCTS CO., LTD, Zhejiang (CN)

(72) Inventors: Yuanru Sun, Zhejiang (CN); Chao Zeng, Zhejiang (CN); Qiwang Ying, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 106 days.

(21) Appl. No.: 17/386,541

(22) Filed: Jul. 28, 2021

(65) Prior Publication Data

US 2021/0355703 A1 Nov. 18, 2021

Related U.S. Application Data

(63) Continuation-in-part of application No. 16/642,015, filed as application No. PCT/CN2019/085931 on May 8, 2019, now Pat. No. 11,199,023.

(30) Foreign Application Priority Data

Apr. 26, 2019 (CN) ..... 201920587861.2

(51) Int. Cl.
*E04H 15/46* (2006.01)
*E04H 15/60* (2006.01)

(52) U.S. Cl.
CPC ..... *E04H 15/46* (2013.01); *E04H 15/60* (2013.01)

(58) Field of Classification Search
CPC ..... E04H 15/46; E04H 15/28; A45B 25/08; A45B 25/06
USPC ..... 135/43
See application file for complete search history.

(56) References Cited

U.S. PATENT DOCUMENTS 10,060,153 B2 * 8/2018 Song ..... E04H 15/34
10,107,005 B2 * 10/2018 Song ..... E04H 15/44
10,273,710 B2 * 4/2019 Yang ..... E05B 65/00
10,982,464 B2 * 4/2021 Ying ..... E04H 15/44
(Continued)

OTHER PUBLICATIONS

Jared Owen, How does a door handle work?, Oct. 8, 2016, https://www.youtube.com/watch?v=WX8NG0275R4.†

*Primary Examiner* — Noah Chandler Hawk
(74) *Attorney, Agent, or Firm* — JCIP GLOBAL INC.

(57) ABSTRACT

A foldable tent center lock device with a rotary unlocking structure, which includes a center telescopic rod. The center telescopic rod includes an outer tube and an inner tube. An upper end of the outer tube is fixedly provided with a top disc. A lower end of the inner tube is fixedly provided with a bottom disc assembly. The bottom disc assembly includes a bottom disc body, a rotating disc cooperating rotatably with the bottom disc body, and a locking member mounted cooperatively between the bottom disc body and the rotating disc and used for being in locking cooperation with the outer tube. The center telescopic rod can be retracted so that the foldable tent inner center lock is locked and a foldable tent is expanded. When the rotary disc rotates, the rotating disc unlocks the locking member, so that the center telescopic rod extends to fold the foldable tent.

13 Claims, 18 Drawing Sheets

(56) References Cited

U.S. PATENT DOCUMENTS

| | | | | |
|---|---|---|---|---|
| 2016/0002949 | A1* | 1/2016 | Yang | E04H 15/46<br>135/139 |
| 2019/0368220 | A1* | 12/2019 | Sun | E04H 15/50 |
| 2019/0368232 | A1* | 12/2019 | Sun | E04H 15/505 |
| 2023/0064601 | A1* | 3/2023 | Liu | E04H 15/60 |

* cited by examiner
† cited by third party

FOLDABLE TENT CENTER LOCK DEVICE WITH ROTARY UNLOCKING STRUCTURE

CROSS-REFERENCE TO RELATED APPLICATION

This application is a continuation-in-part application of and claims the priority benefit of U.S. application Ser. No. 16/642,015, filed on Feb. 25, 2020. The application Ser. No. 16/642,015 is a 371 application of International PCT application serial no. PCT/CN2019/085931, filed on May 8, 2019, which claims the priority benefit of China Application no. 201920587861.2, filed on Apr. 26, 2019. The entirety of each of the above-mentioned patent applications is hereby incorporated by reference herein and made a part of this specification.

FIELD OF TECHNOLOGY

The present invention belongs to the field of outdoor supplies, in particular, relates to a foldable tent center lock device with a rotary unlocking structure.

BACKGROUND

Foldable tents are a popular outdoor supply, and traditional foldable tents are usually composed of columns, center lock devices, upper top rods, bottom top rods, external support rods, inner support rod side rods and tent cloths. The existing center lock device has the problem of inaccessible operation, which affects the user experience.

SUMMARY

To overcome the shortcomings in the prior art, the present invention provides a technical solution of a foldable tent center lock device with a rotary unlocking structure.

A foldable tent center lock device with a rotary unlocking structure includes a center telescopic rod, the center telescopic rod including an outer tube on an outermost side and an inner tube on an innermost side, an upper end of the outer tube being fixedly provided with a top disc, a lower end of the inner tube being fixedly provided with a bottom disc assembly, wherein the bottom disc assembly includes a bottom disc body, a rotating disc cooperating rotatably with the bottom disc body, and a locking member mounted cooperatively between the bottom disc body and the rotating disc and used for being in locking cooperation with the outer tube; the center telescopic rod can be retracted so that a foldable tent inner center lock is locked and a foldable tent is expanded; when the rotating disc rotates, the rotating disc may unlock the locking member from the outer tube, so that the center telescopic rod extends to fold the foldable tent.

The foldable tent center lock device with a rotary unlocking structure, wherein the locking member is a locking sliding sleeve, and the locking sliding sleeve is further cooperatively provided with an unlocking member; the unlocking member may be driven by the rotating disc and further drive the locking sliding sleeve, the locking sliding sleeve is provided with a tab, and the tab is used for being in locking cooperation with a notch of the outer tube.

The foldable tent center lock device with a rotary unlocking structure, wherein the locking sliding sleeve is provided with a slope structure, and the unlocking member is provided with a sliding block for abutting against the slope structure; when the unlocking member rotates with the rotating disc, the sliding block of the unlocking member may push the locking sliding sleeve to move and unlock the locking sliding sleeve from the outer tube by contacting the slope structure.

The foldable tent center lock device with a rotary unlocking structure, wherein the bottom disc body is provided with a sliding groove used for being in sliding cooperation with the locking member.

The foldable tent center lock device with a rotary unlocking structure, wherein the bottom disc body further includes a first elastic reset member for driving the locking member to reset, the first elastic reset member is a spring, and the spring is connected cooperatively between the locking member and the bottom disc body.

The foldable tent center lock device with a rotary unlocking structure, wherein the bottom disc body further includes a second elastic reset member for driving the unlocking member to reset, the second elastic reset member is an elastic snap ring limitedly mounted in the rotating disc, and the elastic snap ring may rotate with the rotating disc when the rotating disc rotates.

The foldable tent center lock device with a rotary unlocking structure, wherein the bottom disc assembly further includes a limit member in fixed cooperation with the bottom disc body, and the limit member has a stopper for abutting against the elastic snap ring; when the elastic snap ring rotates with the rotating disc, the stopper may deform the elastic snap ring so that the elastic snap ring may further drive the rotating disc and the unlocking member together to reset through deformation elasticity after being rotated.

The foldable tent center lock device with a rotary unlocking structure, wherein the elastic snap ring includes outer arc-shaped portions provided integrally and two inner extension portions formed by extending gaps of the outer arc-shaped portions inward, and the stopper is located between the two inner extension portions.

The foldable tent center lock device with a rotary unlocking structure, wherein the rotating disc has a mounting groove for being embedded with the elastic snap ring.

The foldable tent center lock device with a rotary unlocking structure, wherein the bottom disc body and the rotating disc are provided one above the other, and a mounting space for accommodating the locking sliding sleeve, the unlocking member and the limit member is formed between the bottom disc body and the rotating disc.

The foldable tent center lock device with a rotary unlocking structure, wherein the bottom disc body, the locking sliding sleeve, the unlocking member, the limit member and the rotating disc are provided one above the other in succession, and the bottom disc body, the locking sliding sleeve, the unlocking member and the limit member are all ring-shaped members.

The foldable tent center lock device with a rotary unlocking structure, wherein a plurality of first mounting posts are arranged around one of the rotating disc and the unlocking disc, and a plurality of first mounting holes corresponding to the first mounting posts are arranged around the other of the rotating disc and the unlocking disc; the first mounting posts are connected cooperatively with the first mounting holes via fasteners, and a plurality of limit grooves for the first mounting posts to pass through and in sliding cooperation with the first mounting posts are arranged around the limit member.

The foldable tent center lock device with a rotary unlocking structure, wherein a plurality of second mounting posts are arranged around one of the bottom disc body and the limit member, and a plurality of second mounting holes corresponding to the second mounting posts are arranged around the other of the bottom disc body and the limit member; the second mounting posts are connected cooperatively with the second mounting holes via the fasteners.

The foldable tent center lock device with a rotary unlocking structure, wherein a center of the limit member is provided with an inner tube mounting portion used for being in fixed cooperation with the inner tube.

The foldable tent center lock device with a rotary unlocking structure, wherein an outer portion of the rotating disc has an anti-slip surface.

The foldable tent center lock device with a rotary unlocking structure, wherein the bottom disc body is provided cooperatively with a lower disc member, and the rotating disc is located between the bottom disc body and the lower disc member; the lower disc member is provided with connection posts facing vertically upward, and the rotating disc is provided with vertically-penetrating arc-shaped stroke holes corresponding to the connection posts; the connection posts are fixedly connected with the bottom disc body after passing through the arc-shaped stroke holes, and the rotating disc may rotate with the arc-shaped stroke holes and drive the locking member to deform and unlock.

The foldable tent center lock device with a rotary unlocking structure, wherein the locking member adopts an elastic locking member, and the elastic locking member includes arc-shaped portions provided integrally and two locking rods being horizontal formed by extending gaps of the arc-shaped portions inward.

The foldable tent center lock device with a rotary unlocking structure, wherein an inner wall of the rotating disc is provided with a locking block, and a clearance is left between the locking block and the inner wall of the rotating disc; the clearance is used for placing closed ends of the arc-shaped portions of the elastic locking member, and two ends of the locking rod of the elastic locking member abut against two sides of the locking block respectively.

Compared with the prior art, the present invention has the following advantages:

1) the present invention adopts structures such as the bottom disc body, the rotating disc and the locking sliding sleeve, so as to realize rotary locking, which is simple and smooth in locking operations, thereby greatly improving sense of experience for the user;

2) the present invention adopts built-in structures such as the locking sliding sleeve, the unlocking member and the limit member, so as to ensure beauty and generosity in appearance of the present invention.

DESCRIPTION OF THE EMBODIMENTS

Figure 1:
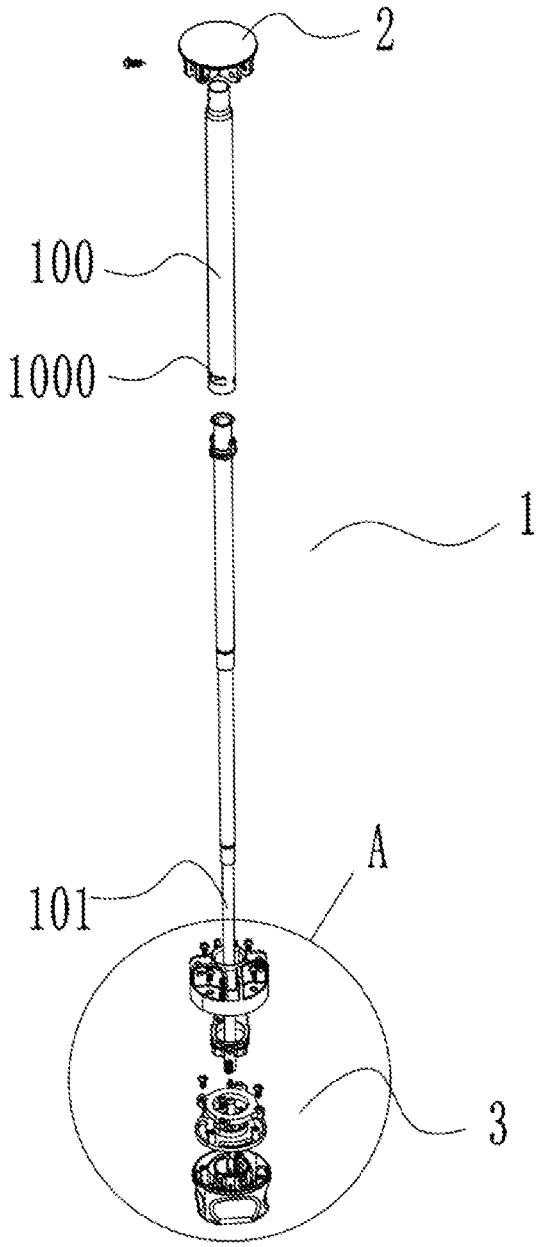
FIG. 1 is an exploded structural diagram of Embodiment 1.

In the descriptions of the present invention, it should be understood that the direction or position relationship indicated by the term "one end", "the other end", "outer side", "upper", "inner side", "horizontal", "co-axially", "center", "end", "length", "outer end" and so on is based on the orientation or position relationship shown in the drawings, and intended only to facilitate the description of the present invention and to simplify the description but not to indicate or imply that the device or component referred to must have a specific orientation, construct and operate in a specific orientation, which thereby should not be considered limitations for the present invention.

The present invention will further be described as below with combination of drawings.

Embodiment 1

With reference to FIGS. 1 to 16, a foldable tent center lock device with a rotary unlocking structure includes a center telescopic rod 1, the center telescopic rod 1 including an outer tube 100 on an outermost side and an inner tube 101 on an innermost side, an upper end of the outer tube 100 being fixedly provided with a top disc 2, a lower end of the inner tube 101 being fixedly provided with a bottom disc assembly 3, wherein when the center telescopic rod 1 is retracted to a shortest length, a lower end of the outer tube 100 is in locking cooperation with the bottom disc assembly 3; the bottom disc assembly 3 includes a bottom disc body 300, a rotating disc 301 cooperating rotatably with the bottom disc body 300, a locking sliding sleeve 302 mounted cooperatively between the bottom disc body 300 and the rotating disc 301 and used for being in locking cooperation with the outer tube 100, and an unlocking member 303 fixedly cooperating with the rotating disc 301 and used for being cooperatively connected with the locking sliding sleeve 302; when the rotating disc 301 rotates, the rotating disc 301 may drive the locking sliding sleeve 302 to be unlocked from the outer tube 100 through the unlocking member 303. The center telescopic rod 1 is preferably a four-section telescopic rod.

Figure 7:
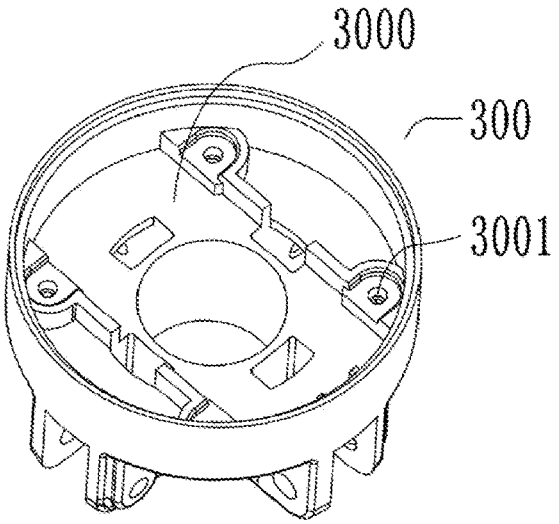
FIG. 7 is a structural diagram of the bottom disc body in Embodiment 1.
Figure 8:
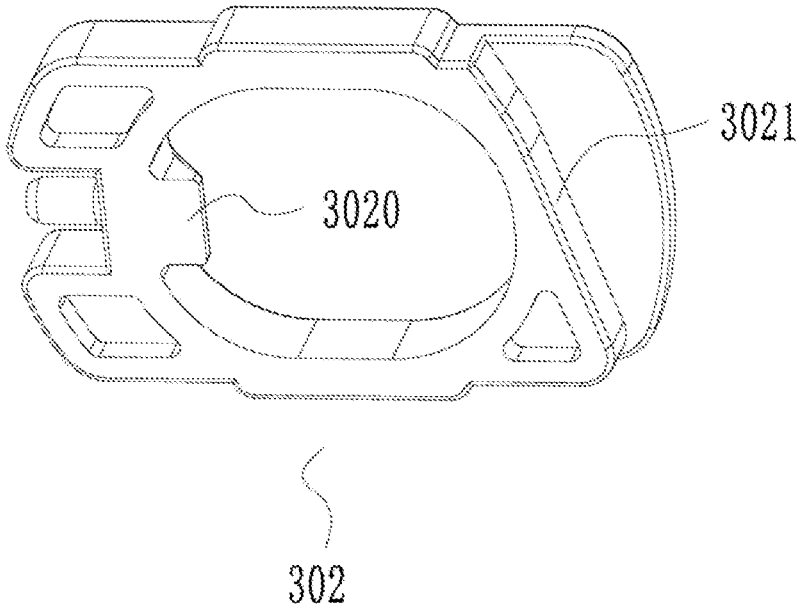
FIG. 8 is a structural diagram of a locking sliding sleeve in Embodiment 1.
Figure 9:
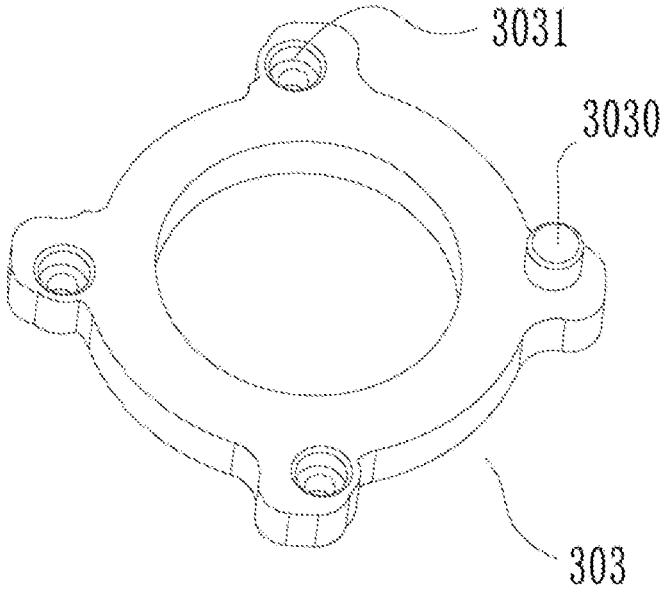
FIG. 9 is one of structural diagrams of an unlocking member in Embodiment 1.

With continuous reference to FIGS. 7 and 8, the locking sliding sleeve 302 is close to a rectangular structure as a whole, the bottom disc body 300 is a ring-shaped member for the center telescopic rod 1 to pass through, the bottom disc body 1 is provided with a sliding groove 3000 corresponding to the locking sliding sleeve 302 in shape, and the bottom disc body 300 is in sliding cooperation with the sliding groove 3000.

With further reference to FIGS. 5, 8, 9 and 10, to enable the unlocking member 303 to unlock the locking sliding sleeve 302, the present invention is arranged as follows: the locking sliding sleeve 302 and the unlocking member 303 are both ring-shaped members and have a hollow structure for the center telescopic rod 1 to pass through, the locking sliding sleeve 302 is further provided with a slope structure 3021, and the unlocking member 303 is provided with a sliding block 3030 for abutting against the slope structure 3021; when the unlocking member 303 rotates with the rotating disc 301, the sliding block 3030 of the unlocking member 303 may push the locking sliding sleeve 302 to move and unlock the locking sliding sleeve 302 from the outer tube 100 by contacting the slope structure 3021.

With continuous reference to FIG. 2, to realize resetting of the locking sliding sleeve 302, the present invention is arranged as follows: the bottom disc body 3 further includes a first elastic reset member for driving the locking sliding sleeve 302 to reset. In a specific application, the first elastic reset member adopts a spring 304, and the spring 304 is connected cooperatively between a side of the locking sliding sleeve 302 opposite to the slope structure 3021 and an inner wall of the sliding groove 3000 of the bottom disc body 300, and the locking sliding sleeve 302 has a column-like structure for positioning the spring 304.

Figure 13:
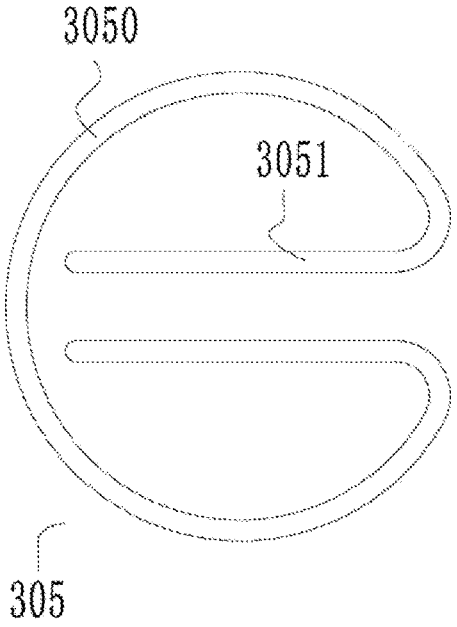
FIG. 13 is a structural diagram of a ring-shaped snap ring in Embodiment 1.

With continuous reference to FIGS. 2 and 13, to realize the resetting of the rotating disc 301 and the unlocking member 303, the present invention is arranged as follows: the bottom disc body 3 further includes a second elastic reset member for driving the unlocking member 303 to reset. The second elastic reset member is an elastic snap ring 305 limitedly mounted in the rotating disc 301, the elastic snap ring 305 includes outer arc-shaped portions 3050 provided integrally and two inner extension portions 3051 formed by extending gaps of the outer arc-shaped portions 3050 inward, and the elastic snap ring 305 may rotate with the rotating disc 301 when the rotating disc 301 rotates.

With continuous reference to FIGS. 1 and 8, the realize the detachable connection between the outer tube 100 and the bottom disc assembly 3, the present invention is arranged as follows: the outer tube 100 is provided with a notch 1000, and the locking sliding sleeve 302 is provided with a tab 3020 for being engaged with the notch 1000. In a specific application, when the foldable tent is expanded so that the center telescopic rod 1 is retracted to a shortest length, the outer tube 100 moves downward relative to the bottom disc assembly 3 and inserts into the bottom disc assembly 3, an outer wall of the outer tube 100 starts by squeezing the tab 3020 to retract the tab 3020, and the tab 3020 is snapped into the notch 1000 under the action of the spring 304 when the notch 1000 moves downward to a position corresponding to the tab 3020.

Figure 11:
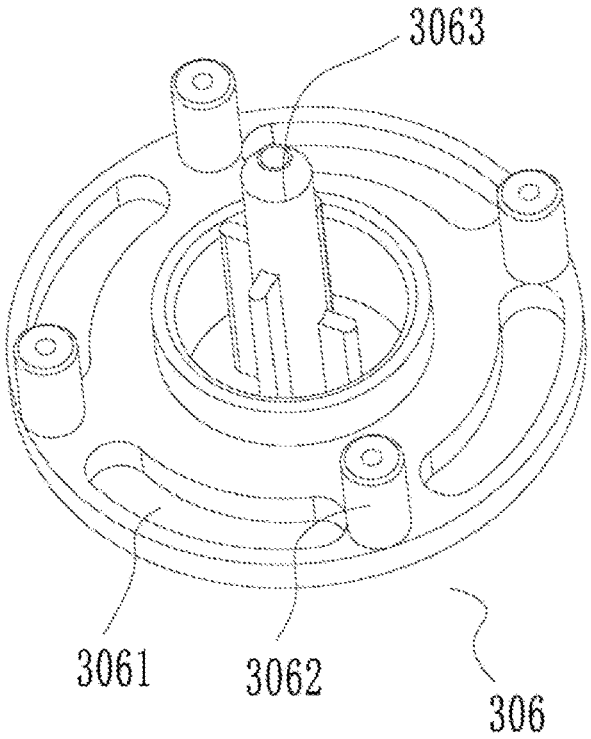
FIG. 11 is one of structural diagrams of a limit member in Embodiment 1.
Figure 12:
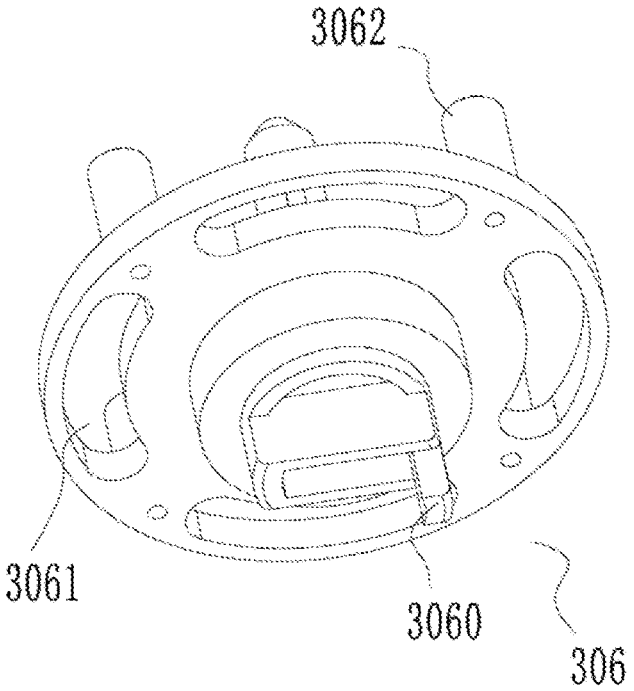
FIG. 12 is the other of structural diagrams of the limit member in Embodiment 1.

With continuous reference to FIGS. 2, 11 and 12, to realize the installation with the inner tube 101 and the deformation of the elastic snap ring 305, the present invention is arranged as follows: the bottom disc assembly 3 further includes a limit member 306 fixedly cooperating with the bottom disc body 300, and the limit member 306 is also the ring-shaped member with the hollow structure for the center telescopic rod 1 to pass through and has a stopper 3060 for abutting against the elastic snap ring 305, so that the stopper 3060 may deform the elastic snap ring 305 and the elastic snap ring 305 may drive the rotating disc 301 to reset together with the unlocking member 303 through the deformation elasticity after being rotated when the elastic snap ring 305 rotates with the rotating disc 301. In a specific application, the stopper 3060 is located between the two extension portions 3051 and located at an end of the inner extension portion 3051 opposite to gaps of the outer arc-shaped portions 3050; when the rotating disc 301 rotates, the elastic snap ring 305 rotates with the rotating disc 301, the inner extension portion 3051 of the elastic snap ring 305 may be deformed due to the blocking of the stopper 3060, and once the rotating disc 301 loses the force for rotating, the elastic snap ring 305 may drive the rotating disc 301 to reset together with the unlocking member 303 with the help of the stopper 3060. At the same time, a center of the limit member 306 is further provided with an inner tube mounting portion 3063 used for being engaged with the inner tube 101 or being fixed via fasteners.

Figure 14:
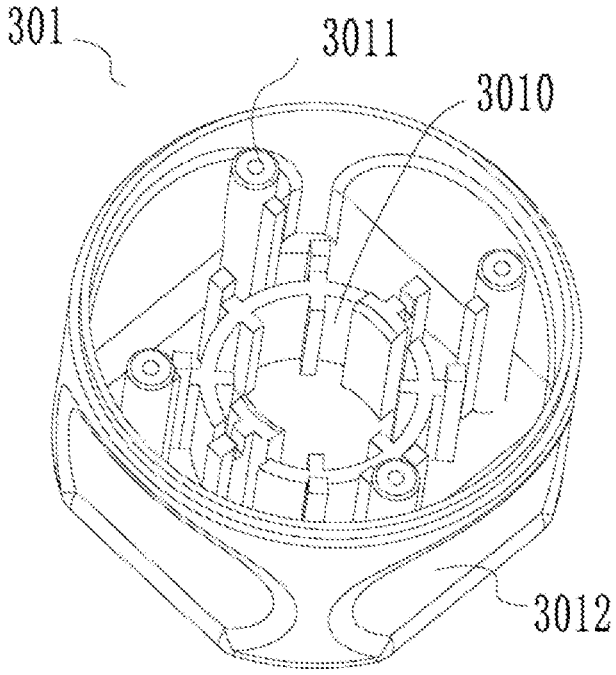
FIG. 14 is a structural diagram of a rotating disc in Embodiment 1.
Figure 15:
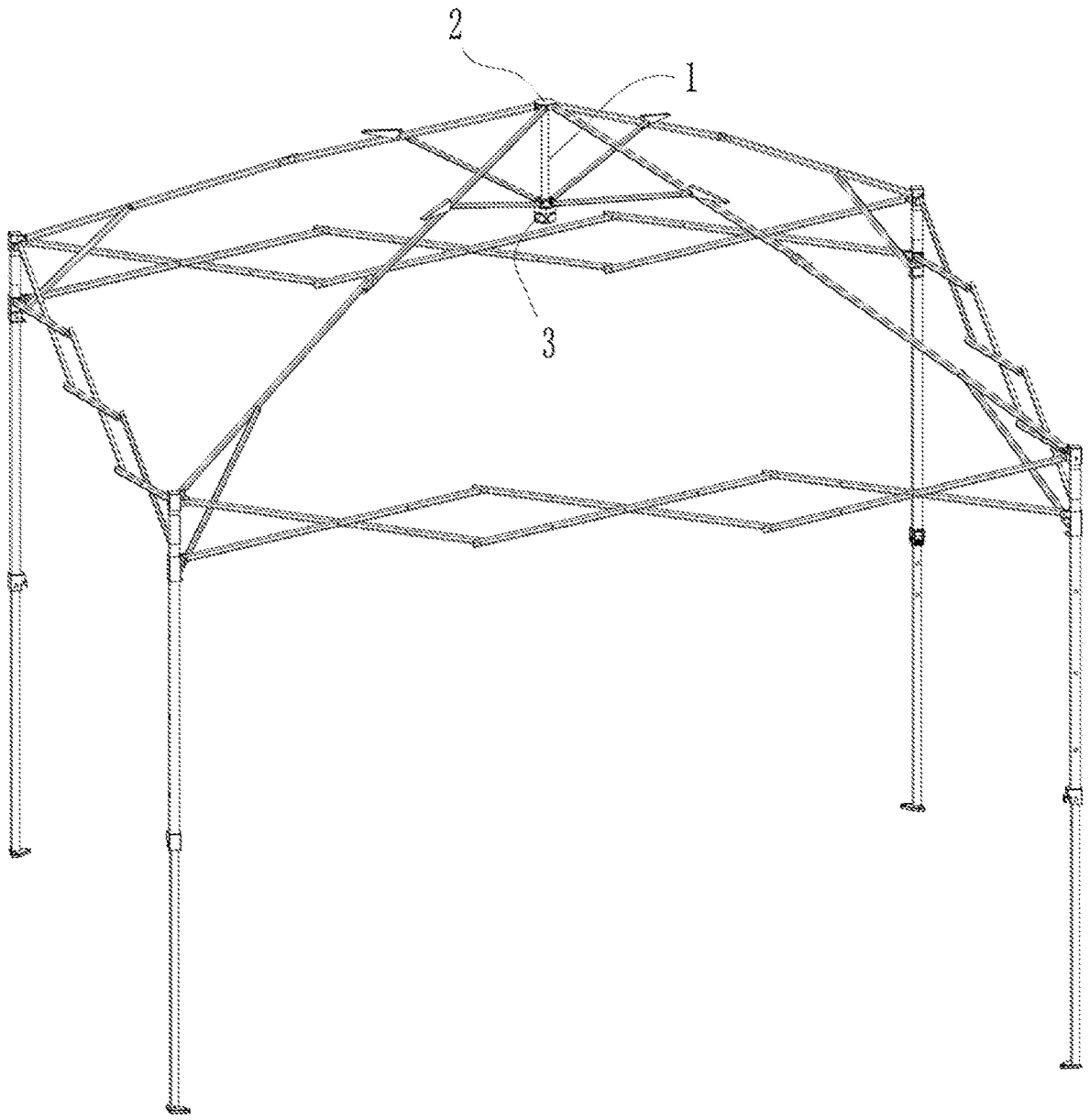
FIG. 15 is one of diagrams showing a use state where Embodiment 1 is applied to a foldable tent, wherein the foldable tent is in a entirely-expanded state.
Figure 16:
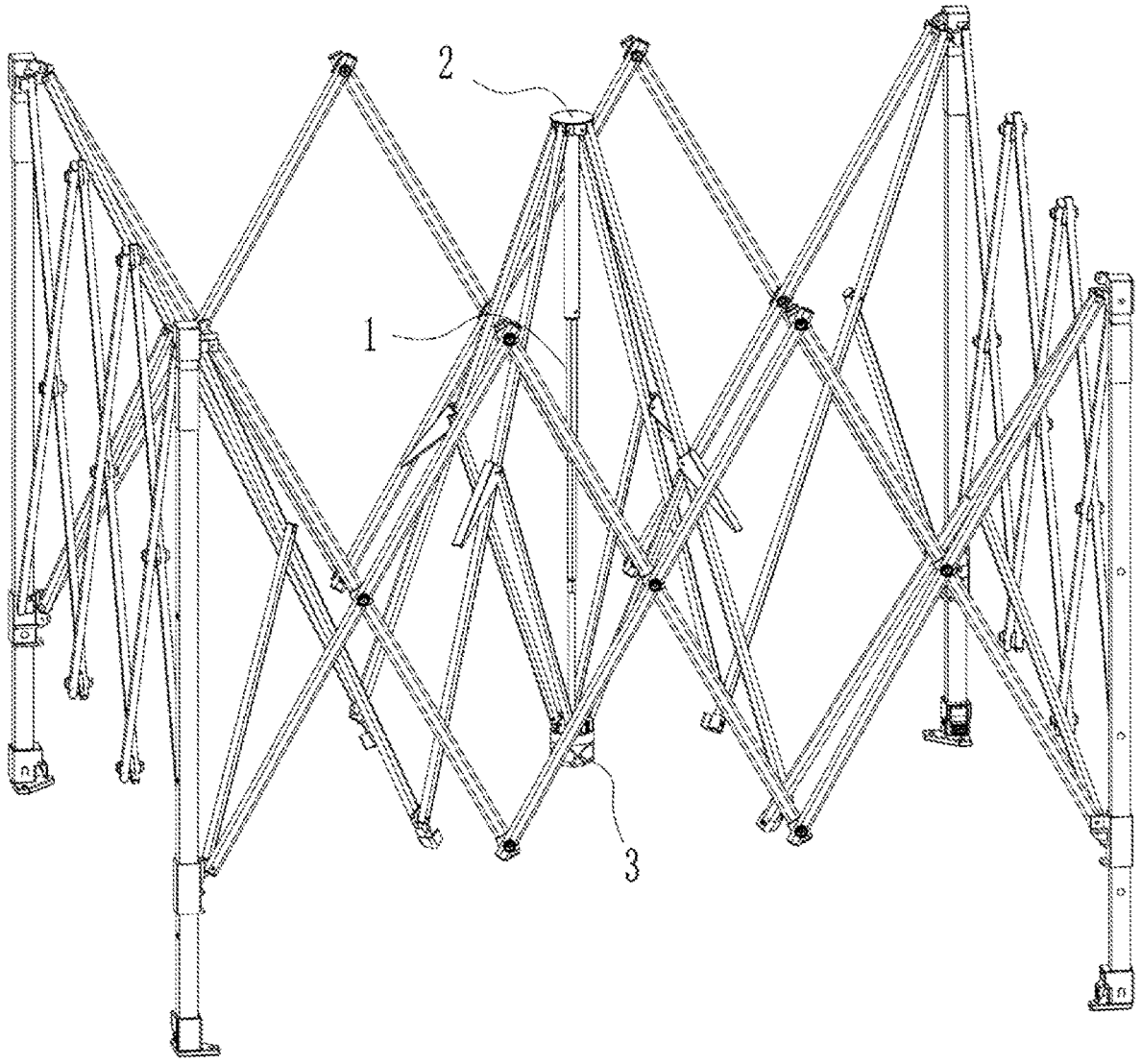
FIG. 16 is the other of diagrams showing a use state where Embodiment 1 is applied to a foldable tent, wherein the foldable tent is in a semi-expanded state.
Figure 17:
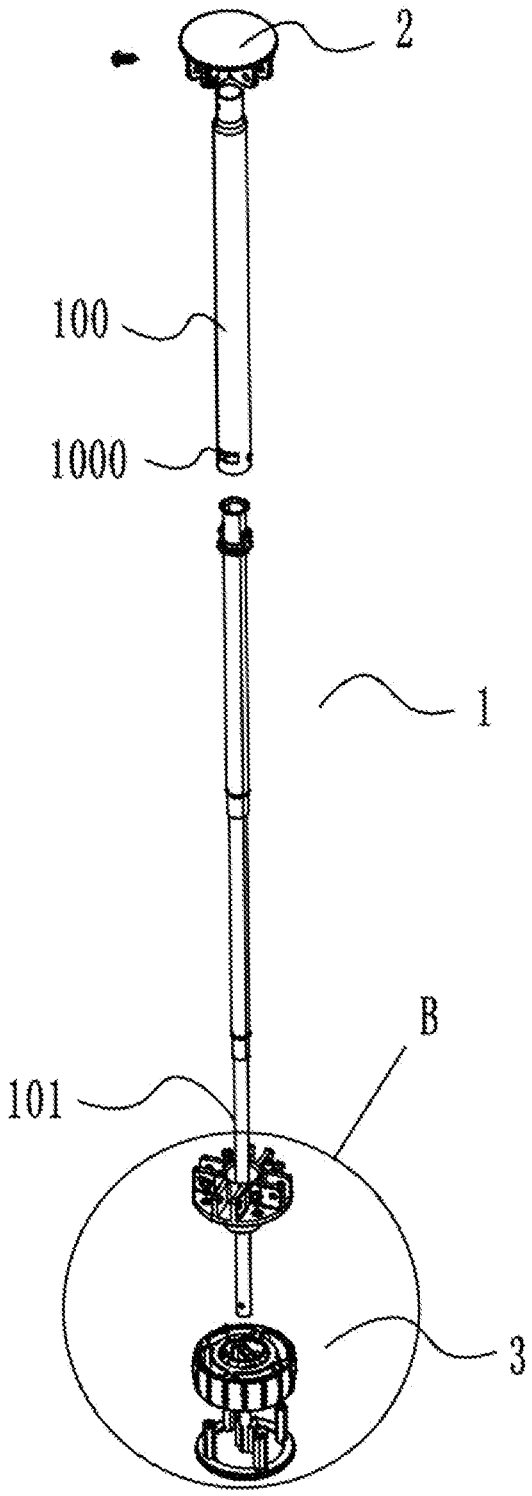
FIG. 17 is an exploded structural diagram of Embodiment 2.

With continuous reference to FIG. 14, the rotating disc 301 has a mounting groove 3010 for being embedded with the elastic snap ring 305, the elastic snap ring 305 is slightly larger than mounting groove 3010 in a natural state, and the elastic snap ring 305 may be fixed in the mounting groove 3010 with elasticity after being mounted into the mounting groove 3010.

Figure 6:
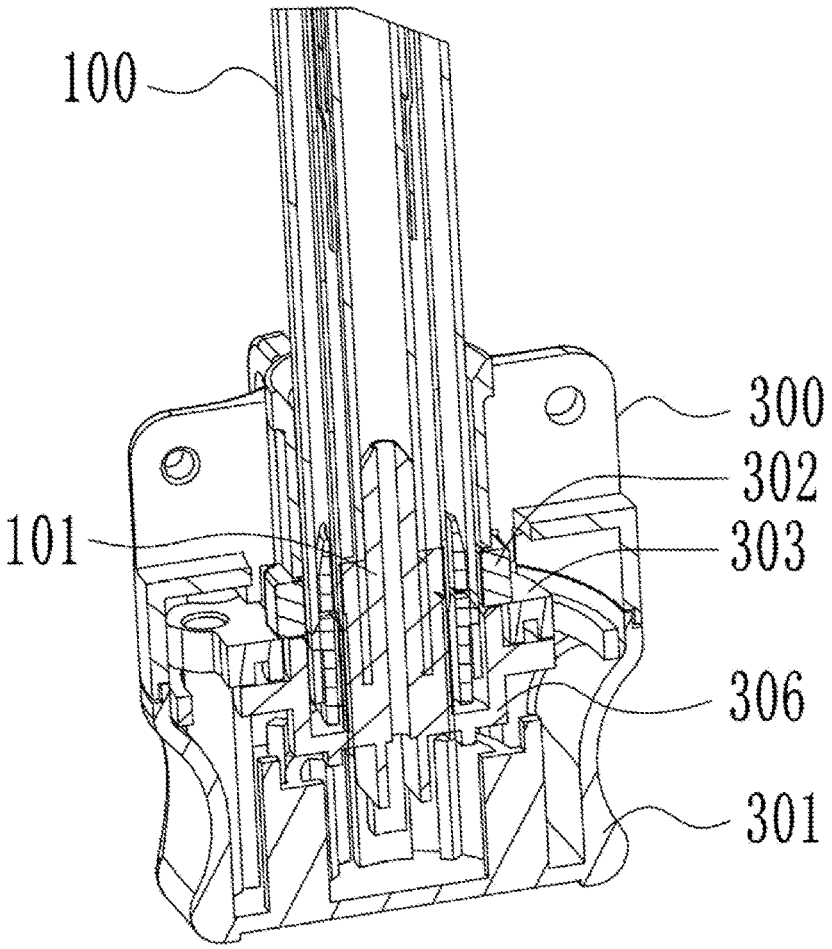
FIG. 6 is a structural cross-section diagram showing connection between the bottom disc assembly and the center telescopic rod in Embodiment 1, wherein the center telescopic rod is in a retracted state.

With continuous reference to FIG. 6, to enable the mounting effect to be compact, the present invention is arranged as follows: the bottom disc body 300, the locking sliding sleeve 302, the unlocking member 303, the limit member 306 and the rotating disc 301 are arranged one above the other in succession, and a mounting space for accommodating the locking sliding sleeve 302, the unlocking member 303 and the limit member 306 is formed between the bottom disc body 300 and the rotating disc 301.

Figure 2:
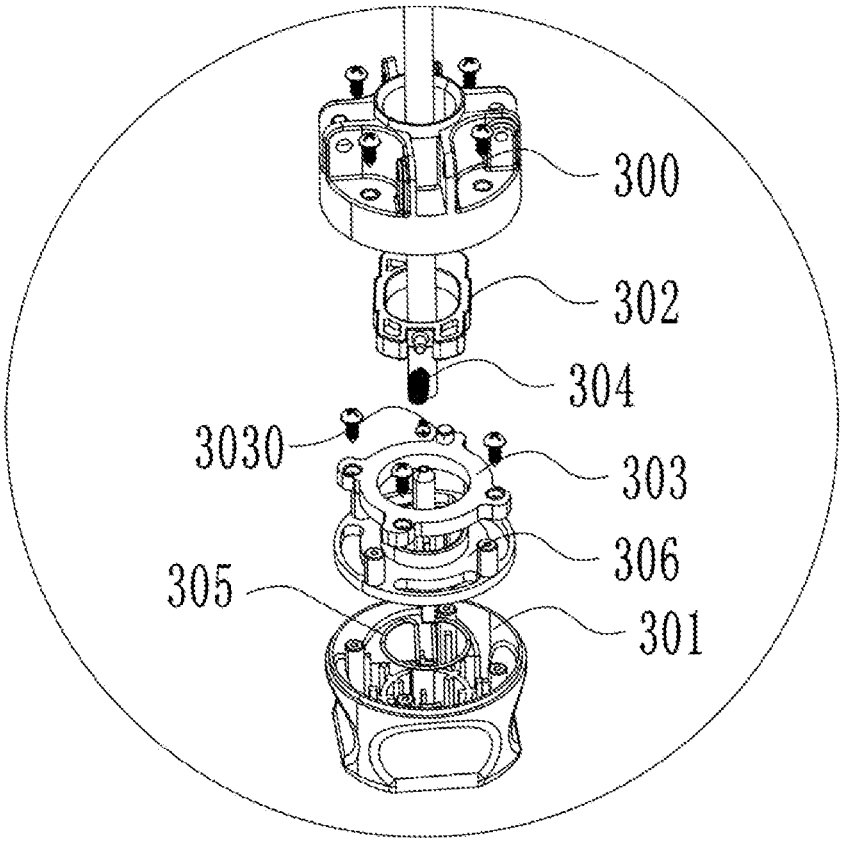
FIG. 2 is an enlarged diagram of A in FIG. 1.
Figure 3:
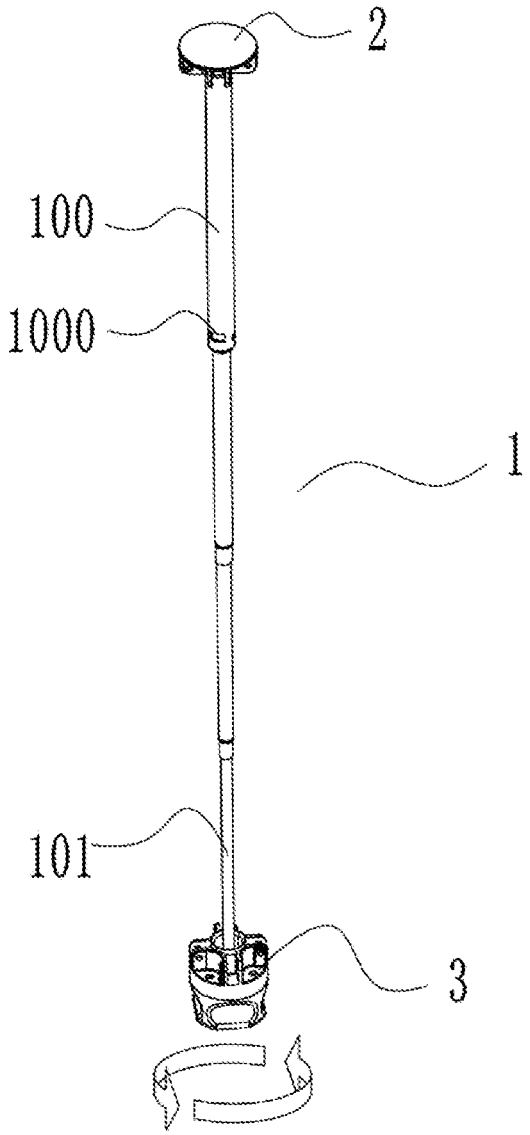
FIG. 3 is one of structural diagrams of Embodiment 1, showing an extension state of a center telescopic rod.
Figure 4:
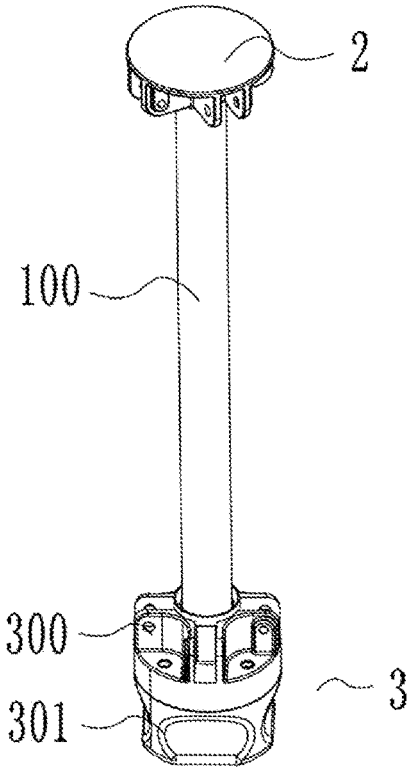
FIG. 4 is the other of structural diagrams of Embodiment 1, showing a retracted state of the center telescopic rod.
Figure 5:
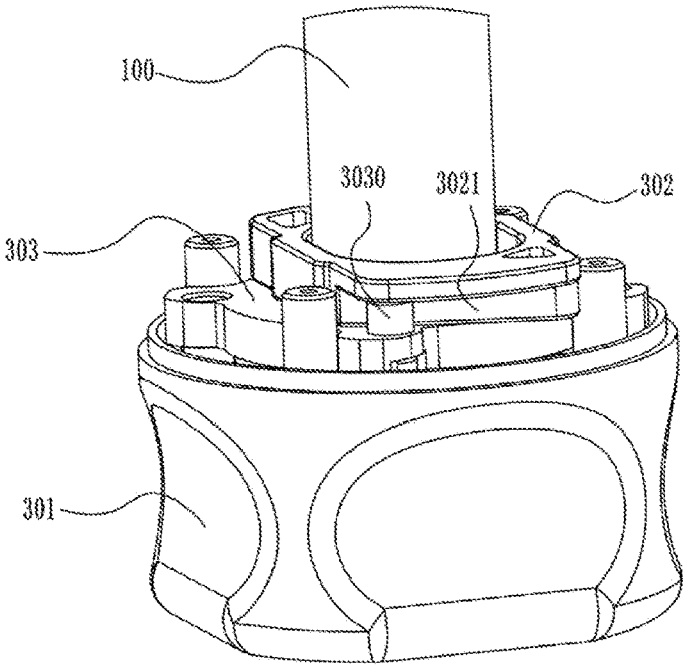
FIG. 5 is a structural diagram showing connection between a bottom disc assembly and an outer tube in Embodiment 1, wherein a bottom disc body is not shown.
Figure 10:
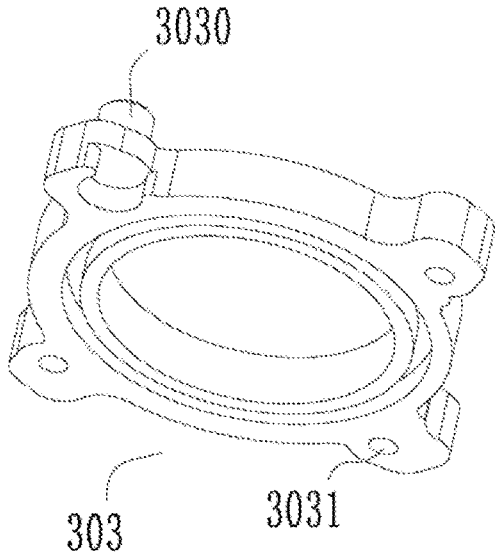
FIG. 10 is the other of structural diagrams of the unlocking member in Embodiment 1.

With continuous reference to FIGS. 2, 10 and 14, on the basis of the above structure, the present invention further describes the connection structure between the rotating disc 301 and the unlocking disc 303: a plurality of first mounting posts 3011 are arranged around the rotating disc 301, and a plurality of first mounting holes 3031 corresponding to the first mounting posts 3011 are arranged around the unlocking member 303; the first mounting posts 3011 are connected cooperatively with the first mounting holes 3031 via fasteners. And, a plurality of limit grooves 3061 for the first mounting posts 3011 to pass through and in sliding cooperation with the first mounting posts 3011 are arranged around the limit member 306, and with the cooperation between the first mounting posts 3011 and the limit groove 3061, a rotating angle of the rotating disc 301 is limited. Mounting positions for the first mounting posts 3011 and the first mounting holes 3031 may be interchanged.

With continuous reference to FIGS. 2, 7, 11 and 12, on the basis of the above structure, the present invention further describes the connection structure between the bottom disc body 300 and the limit member 306: a plurality of second mounting posts 3062 are arranged around the limit member 306, and a plurality of second mounting holes 3001 corresponding to the second mounting posts 3062 are arranged around the bottom disc body 300; the second mounting posts 3062 are connected cooperatively with the second mounting holes 3001 via fasteners. Mounting positions for the second mounting posts 3062 and the second mounting holes 3001 may be interchanged.

In the last, with reference to FIG. 14, an outer portion of the rotating disc 301 has an anti-slip surface 3012, and the anti-slip surface 3012 is easy to be operated manually.

When the foldable tent is expanded entirely, the outer tube 100 moves downward relative the bottom disc assembly 3 and inserts into the bottom disc assembly 3, and the outer tube 100 realizes locking with the locking sliding sleeve 302.

When the foldable tent is folded, the rotating disc 301 is rotated, the rotating disc 301 drives the unlocking member 303 to rotate, and the sliding block 3030 squeezes the slope structure 3021 of the locking sliding sleeve 302 when the unlocking member 303 rotates so that the locking sliding sleeve 302 moves together with the tab 3020 and the tab 3020 exits the notch 1000 of the outer tube 100 for unlocking.

Embodiment 2

With reference to FIGS. 17 to 26, a foldable tent center lock device with a rotary unlocking structure that may realize unlocking by two-way rotation includes a center telescopic rod 1, the center telescopic rod 1 including an outer tube 100 on an outermost side and an inner tube 101 on an innermost side, an upper end of the outer tube 100 being fixedly provided with a top disc 2, a lower end of the inner tube 101 being fixedly provided with a bottom disc assembly 3, wherein the bottom disc assembly 3 includes a bottom disc body 300, a rotating disc 301 cooperating rotatably with the bottom disc body 300, a locking member mounted cooperatively between the bottom disc body 300 and the rotating disc 301 and used for being in locking cooperation with the outer tube, and the center telescopic rod 1 may enable the foldable tent center lock device to lock through retraction and enable the foldable tent to be in an expanded state; when the rotating disc 301 rotates, the rotating disc 301 may unlock the locking member from the outer tube 100, so that the center telescopic rod 1 extends to fold the foldable tent.

Figure 18:
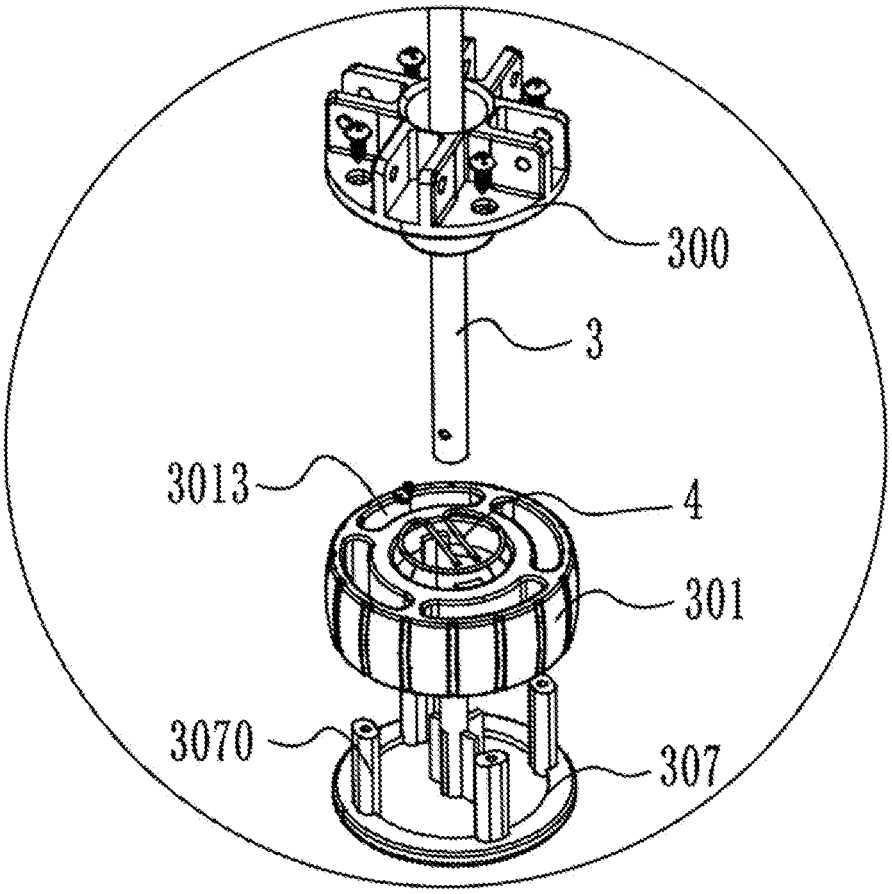
FIG. 18 is an enlarged diagram of B in FIG. 17.
Figure 19:
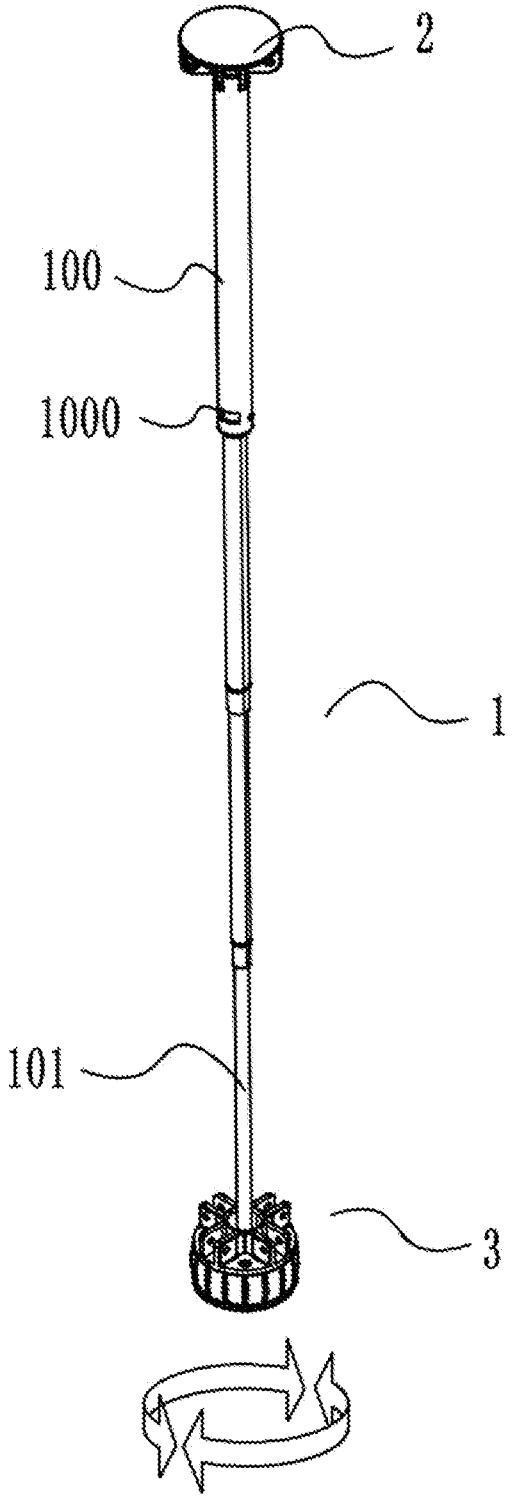
FIG. 19 is one of structural diagrams of Embodiment 2, wherein the center telescopic rod is in an extended state.
Figure 20:
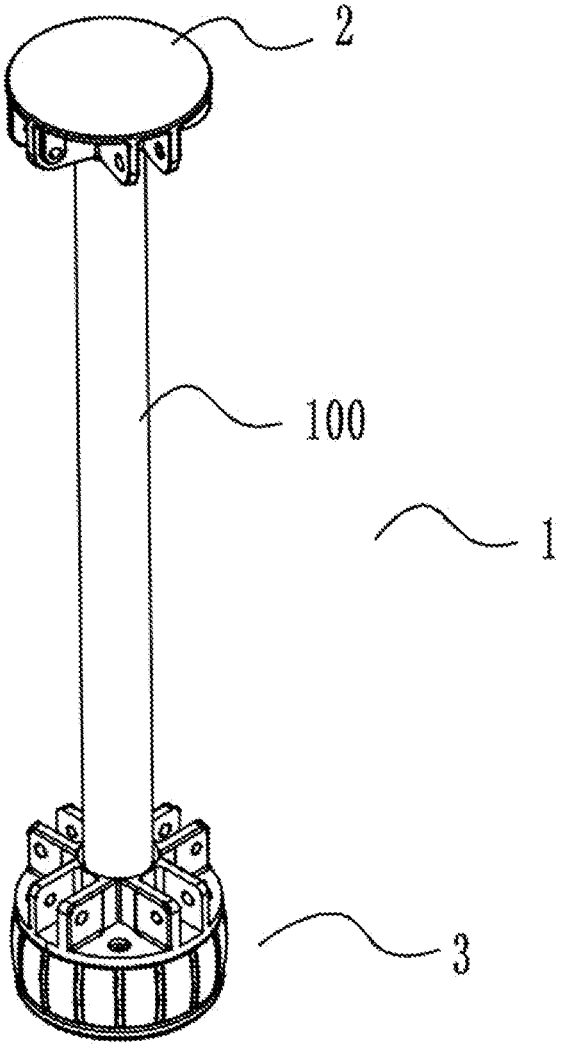
FIG. 20 is the other of structural diagrams of Embodiment 2, wherein the center telescopic rod is in a retracted state.
Figure 21:
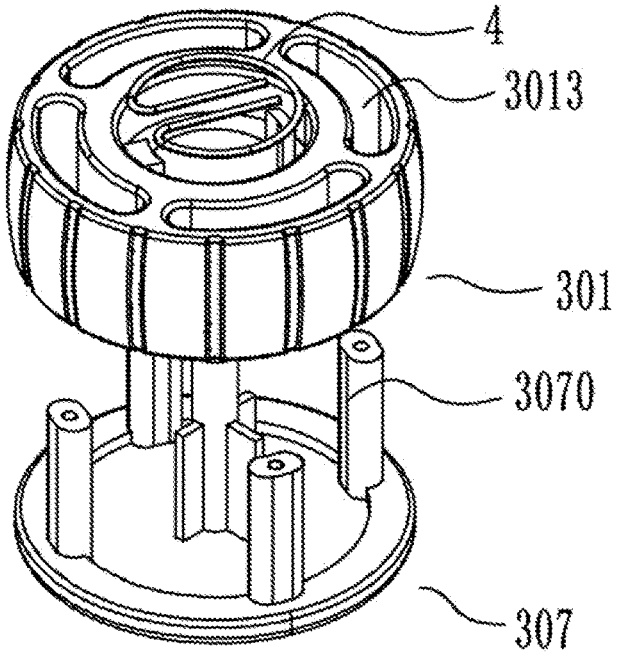
FIG. 21 is a structural diagram showing connection between the rotating disc and a lower disc member in Embodiment 2.
Figure 23:
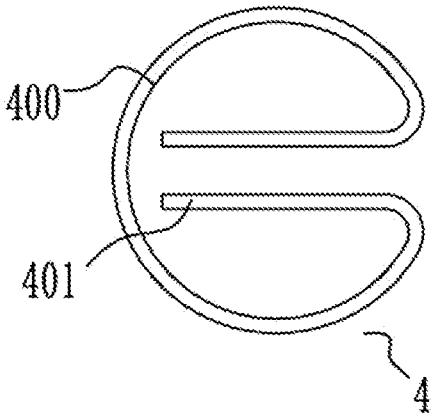
FIG. 23 is a structural diagram of an elastic locking member in Embodiment 2.

With continuous reference to FIGS. 18, 21 and 23, the locking member adopts an elastic locking member 4, and the elastic locking member 4 includes arc-shaped portions 400 provided integrally and two locking rods 401 being horizontal formed by extending gaps of the arc-shaped portions 400 inward.

Figure 22:
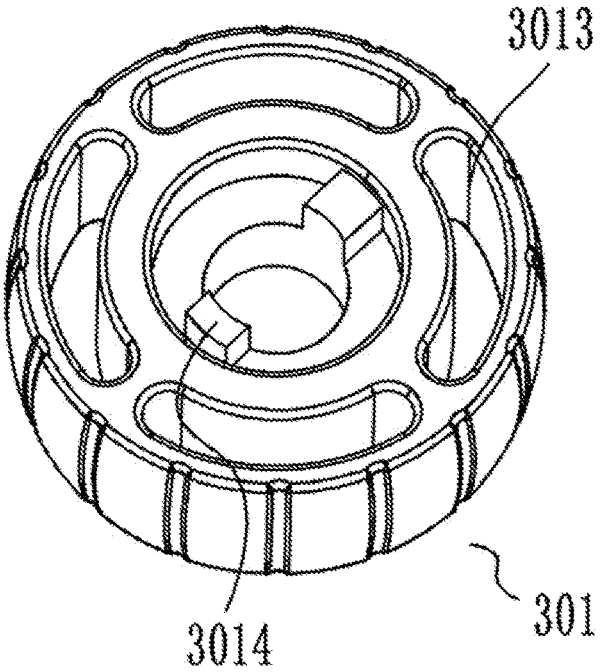
FIG. 22 is a structural diagram of the rotating disc in Embodiment 2.
Figure 24:
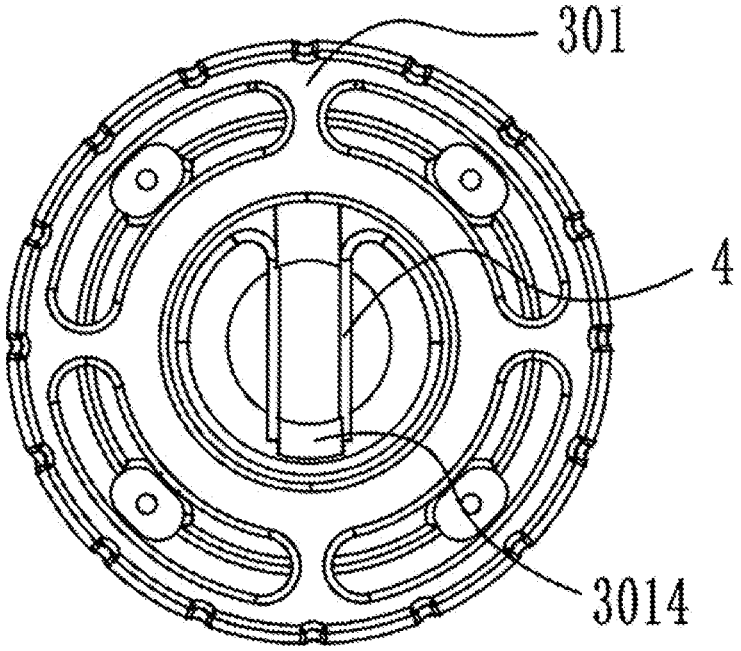
FIG. 24 is a structural diagram showing assembly between the rotating disc and the elastic locking member in Embodiment 2.

With continuous reference to FIGS. 22 and 24, an inner wall of the rotating disc 301 is provided with a locking block 3014, and a clearance is left between the locking block 3014 and the inner wall of the rotating disc 301; the clearance is used for placing closed ends of the arc-shaped portions 400 of the elastic locking member 4, and two ends of the locking rod 401 of the elastic locking member 4 abut against two sides of the corresponding locking block 3014 respectively.

Figure 25:
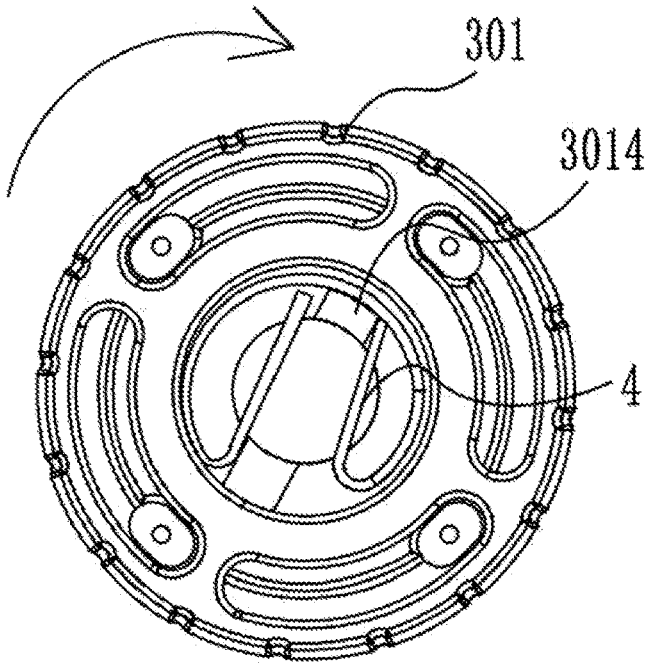
FIG. 25 is a structural diagram of rotating the rotating disc clock-wisely in Embodiment 2.
Figure 26:
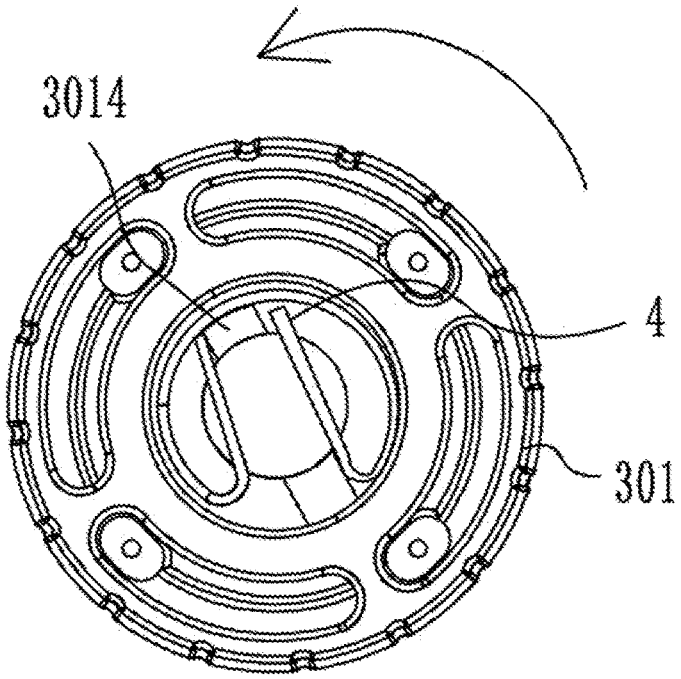
FIG. 26 is a structural diagram of rotating the rotating disc counterclockwisely in Embodiment 2.

In the last, with reference to FIGS. 25 and 26, in the present embodiment, when the unlocking is required, only by rotating the rotating disc 301 clock-wisely or counter-clockwisely, one of two opposite sides of two ends of the locking rod 401 of the elastic locking member 4 abuts against corresponding locking blocks 3014 in a tilted state, and the other of the two opposite sides are away from the corresponding locking blocks 3014 in a tilted state respectively, so that a distance between the two locking rods 401 becomes larger to realize removement from the notch 1000 of the outer tube 100 for unlocking.

Finally, it should be noted that the above embodiments are used only to illustrate the technical solution of the present invention, which are not limited herein; although the present invention is described in detail by reference to the above embodiments, those skilled in the art should understand they may still modify the technical solutions documented in the preceding embodiments, or replace some or all of the technical features equally; these modifications or replacements do not remove the essence of the corresponding technical solution from the scope of the technical solutions of the embodiments of the present invention.

What is claimed is:

1. A foldable tent center lock device with a rotary unlocking structure, the center lock device comprising a center telescopic rod, the center telescopic rod comprising an outer tube on an outermost side and an inner tube on an innermost side, an upper end of the outer tube being fixedly provided with a top disc, a lower end of the inner tube being fixedly provided with a bottom disc assembly, wherein the bottom disc assembly comprises a bottom disc body, a rotating disc cooperating rotatably with the bottom disc body, and a locking member mounted cooperatively between the bottom disc body and the rotating disc and used for being in locking cooperation with the outer tube; the center telescopic rod may be retracted so that a foldable tent inner center lock is locked and a foldable tent is expanded; when the rotating disc rotates, the rotating disc may unlock the locking member from the outer tube, so that the center telescopic rod extends to fold the foldable tent, wherein the locking member is a locking sliding sleeve, and the locking sliding sleeve is further cooperatively provided with an unlocking member; the unlocking member may be driven by the rotating disc and further drive the locking sliding sleeve, the locking sliding sleeve is provided with a tab, and the tab is used for being in locking cooperation with a notch of the outer tube, wherein the bottom disc body further comprises a second elastic reset member for driving the unlocking member to reset, the second elastic reset member is an elastic snap ring limitedly mounted in the rotating disc, and the elastic snap ring may rotate with the rotating disc when the rotating disc rotates.

2. The foldable tent center lock device with a rotary unlocking structure according to claim 1, wherein the locking sliding sleeve is provided with a slope structure, and the unlocking member is provided with a sliding block for abutting against the slope structure; when the unlocking member rotates with the rotating disc, the sliding block of the unlocking member may push the locking sliding sleeve to move and unlock the locking sliding sleeve from the outer tube by contacting the slope structure.

3. The foldable tent center lock device with a rotary unlocking structure according to claim 1, wherein the bottom disc body is provided with a sliding groove used for being in sliding cooperation with the locking member.

4. The foldable tent center lock device with a rotary unlocking structure according to claim 1, wherein the bottom disc body further comprises a first elastic reset member for driving the locking member to reset, the first elastic reset member is a spring, and the spring is connected cooperatively between the locking member and the bottom disc body.

5. The foldable tent center lock device with a rotary unlocking structure according to claim 1, wherein the bottom disc assembly further comprises a limit member in fixed cooperation with the bottom disc body, and the limit member has a stopper for abutting against the elastic snap ring; when the elastic snap ring rotates with the rotating disc, the stopper may deform the elastic snap ring so that the elastic snap ring may further drive the rotating disc and the unlocking member together to reset through deformation elasticity after being rotated.

6. The foldable tent center lock device with a rotary unlocking structure according to claim 5, wherein the elastic snap ring comprises outer arc-shaped portions provided integrally and two inner extension portions formed by extending gaps of the outer arc-shaped portions inward, and the stopper is located between the two inner extension portions.

7. The foldable tent center lock device with a rotary unlocking structure according to claim 6, wherein the rotating disc has a mounting groove for being embedded with the elastic snap ring.

8. The foldable tent center lock device with a rotary unlocking structure according to claim 7, wherein the bottom disc body and the rotating disc are provided one above the other, and a mounting space for accommodating the locking sliding sleeve, the unlocking member and the limit member is formed between the bottom disc body and the rotating disc.

9. The foldable tent center lock device with a rotary unlocking structure according to claim 8, wherein the bottom disc body, the locking sliding sleeve, the unlocking member, the limit member and the rotating disc are provided one above the other in succession, and the bottom disc body, the locking sliding sleeve, the unlocking member and the limit member are all ring-shaped members.

10. The foldable tent center lock device with a rotary unlocking structure according to claim 9, wherein a plurality of first mounting posts are arranged around one of the rotating disc and the unlocking disc, and a plurality of first mounting holes corresponding to the first mounting posts are arranged around the other of the rotating disc and the unlocking disc; the first mounting posts are connected cooperatively with the first mounting holes via fasteners, and a plurality of limit grooves for the first mounting posts to pass through and in sliding cooperation with the first mounting posts are arranged around the limit member.

11. The foldable tent center lock device with a rotary unlocking structure according to claim 10, wherein a plurality of second mounting posts are arranged around one of the bottom disc body and the limit member, and a plurality of second mounting holes corresponding to the second mounting posts are arranged around the other of the bottom disc body and the limit member; the second mounting posts are connected cooperatively with the second mounting holes via the fasteners.

12. The foldable tent center lock device with a rotary unlocking structure according to claim 1, wherein a center of the limit member is provided with an inner tube mounting portion used for being in fixed cooperation with the inner tube.

13. The foldable tent center lock device with a rotary unlocking structure according to claim 1, wherein an outer portion of the rotating disc has an anti-slip surface.

* * * * *